US007106989B2

(12) United States Patent
Eom

(10) Patent No.: US 7,106,989 B2
(45) Date of Patent: Sep. 12, 2006

(54) METHOD AND APPARATUS FOR CONTROLLING HIGH-VOLTAGE OUTPUT IN IMAGE FORMING SYSTEM

(75) Inventor: Yoon-seop Eom, Gyeonggi-do (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 39 days.

(21) Appl. No.: 10/901,205

(22) Filed: Jul. 29, 2004

(65) Prior Publication Data

US 2005/0031369 A1 Feb. 10, 2005

(30) Foreign Application Priority Data

Aug. 4, 2003 (KR) ..... 10-2003-0053907

(51) Int. Cl.
*G03G 15/00* (2006.01)

(52) U.S. Cl. ..... 399/88

(58) Field of Classification Search ..... 399/88–89
See application file for complete search history.

(56) References Cited

U.S. PATENT DOCUMENTS

| | | | | |
|---|---|---|---|---|
| 4,809,037 A | | 2/1989 | Sato | |
| 5,627,722 A | | 5/1997 | Hirst | |
| 5,848,321 A | * | 12/1998 | Roh et al. | 399/45 |
| 5,887,219 A | * | 3/1999 | Eom | 399/45 |
| 6,111,594 A | * | 8/2000 | Jeong | 347/140 |
| 6,226,472 B1 | * | 5/2001 | Yun | 399/81 |
| 6,546,345 B1 | * | 4/2003 | Ghiasi | 702/67 |
| 2002/0153419 A1 | * | 10/2002 | Hall | 235/400 |
| 2003/0116408 A1 | * | 6/2003 | Topmiller et al. | 198/781.05 |
| 2003/0120822 A1 | * | 6/2003 | Langrind et al. | 709/251 |

FOREIGN PATENT DOCUMENTS

| | | |
|---|---|---|
| JP | 61-262760 | 11/1986 |
| JP | 4-115265 | 4/1992 |
| JP | 7-287431 | 10/1995 |
| JP | 2001-273116 | 10/2001 |
| JP | 2002-287600 | 10/2002 |
| JP | 2002-351187 | 12/2002 |
| KR | 1995-8136 | 4/1995 |
| KR | 10-2001-0038693 | 5/2001 |
| KR | 10-2001-0038693 A * | 5/2001 |

* cited by examiner

*Primary Examiner*—William J. Royer
(74) *Attorney, Agent, or Firm*—Staas & Halsey LLP

(57) ABSTRACT

A method and an apparatus to control a high voltage output in an image forming system. The method includes setting a master processor to control an engine, and setting a slave processor to control a high voltage output; transmitting a command, which includes a timing and a level of the high voltage output, from the master processor to the slave processor; and determining the timing and level of the high voltage output after analyzing the received command, and controlling the high voltage output according to a predetermined high voltage output synchronization signal by the slave processor.

25 Claims, 6 Drawing Sheets

METHOD AND APPARATUS FOR CONTROLLING HIGH-VOLTAGE OUTPUT IN IMAGE FORMING SYSTEM

CROSS-REFERENCE TO RELATED APPLICATIONS

This application claims the priority of Korean Patent Application No. 2003-53907, filed on Aug. 4, 2003, in the Korean Intellectual Property Office, the disclosure of which is incorporated herein in its entirety by reference.

BACKGROUND OF THE INVENTION

1. Field of the Invention

The present invention relates to an image forming system, and more particularly, to a method and an apparatus to control a high voltage output while reducing loads on a main processor in an engine controlling module by simplifying a control signal line.

2. Description of the Related Art

In an image forming system using an electro-photographic method, when light corresponding to image information is scanned by an exposure device onto a photosensitive medium which is thus charged to a predetermined electric potential, an electrostatic latent image is formed on the photosensitive medium. Then, a developer provides toner on the electrostatic latent image to form a toner image. In a color electro-photographic method, four developers, each of which contains a color toner such as cyan, magenta, yellow, and black, are required to form an image. The formed toner image is transferred to a sheet of paper directly from a photosensitive medium or by passing through an intermediate transfer medium. When the transferred toner image passes through a fuser, the toner image is fused on the paper by heat and pressure. The mono-color image or multiple color image is printed on the paper via the above processes.

A color image can be formed with, for example, a single-pass method, wherein four exposure units and four photosensitive media are used, or a multi-pass method, wherein one exposure unit and one photosensitive medium are used. In both methods, four color toners as described above are required. The printing speed in the single-pass method is the same for mono-color printing and multiple color printing, thus high speed color printing can be performed. In the multi-pass method, it takes at least four times longer to print a multiple color image as opposed to a mono-color image. However, a printing operation in the multi-pass method can be performed with an apparatus having a simpler structure than that used to perform a printing operation in the single-pass method.

In the above image forming system, a plurality of high voltages are required to charge, develop, transfer, clean, and paper adsorb. In the single-pass method, 20 pulse width modulation output ports including 4 ports to supply charging high voltage, 4 ports to supply developing high voltage, 4 ports to supply a first transfer high voltage, 4 ports to supply cleaning high voltage, and 2 ports to supply paper adsorbing high voltage, and 19 control ports are required. On the other hand, the multi-pass method requires 4 PWM output ports including a port to supply charging high voltage, one port to supply developing high voltage, one port to supply a first transfer high voltage, and one port to supply second transfer high voltage, and control ports corresponding to the PWM ports.

In the single-pass method, since more control ports for high voltage output are used, more control signal lines between a main processor including an engine controlling module and a high voltage output module are required. Additionally, more pins are necessary and a total length of a harness increases. Thus, the single-pass method has disadvantages such as high fabrication cost and high sensitivity to errors due to various noises. Also, since control signals of the high voltage output module are generated in the main processor of the engine controlling module, the main processor should operate the engine and control the high voltage output simultaneously. Thus, an expensive main processor operating at a higher speed is required.

SUMMARY OF THE INVENTION

Accordingly, it is an aspect of the present invention to provide a method and an apparatus to control a high voltage output, while reducing loads on a main processor in an engine controlling module, by simplifying a control signal line, and an image forming system using the method and apparatus.

Additional aspects and/or advantages of the invention will be set forth in part in the description which follows and, in part, will be obvious from the description, or may be learned by practice of the invention.

The foregoing and/or other aspects of the present invention may be achieved by providing a method of controlling a high voltage output in an image forming system, the method including setting a master processor to control an engine, and setting a slave processor to control the high voltage output, transmitting a command, which includes a timing and a level of the high voltage output, from the master processor to the slave processor, receiving and analyzing the transmitted command by the slave processor; and deciding the timing and the level of the high voltage output, and controlling the high voltage output according to a predetermined high voltage output synchronization signal received by the slave processor.

The method of controlling a high voltage output may further include measuring detection values for environment recognition in the image forming system during a predetermined time, and transmitting the measured values to the master processor by the slave processor, and controlling the timing and the level of the high voltage output according to the command transmitted by the master processor.

The foregoing and/or other aspects of the present invention may also be achieved by providing an apparatus to control a high voltage output in an image forming system, the apparatus including: a first memory storing a control program and a timing and a level of the high voltage, which are used in a previous printing operation; a master processor performing engine controlling operations using the control program stored in the first memory, and transmitting a command including the timing and the level of the high voltage output stored in the first memory; a slave processor deciding the timing and the level of the high voltage output by analyzing the generated command, which is received from the master processor, and controlling the high voltage output according to a high voltage output synchronization signal; and a second memory storing the timing and the level of the high voltage output decided by the slave processor.

The foregoing and/or other aspects of the present invention may also be achieved by providing an image forming system including an image processor converting printing data, which is received from a computer requiring a printing operation, into image data driving an engine, an engine controller receiving the image data from the image processor, performing an engine controlling operation using a predetermined control program, and generating a command including a timing and a level of a high voltage output, a high voltage controller deciding the timing and the level of the high voltage output by analyzing the generated command, which is received from the engine controller, and controlling the high voltage output according to a predetermined high voltage output synchronization signal, a high voltage output unit generating and outputting a plurality of high voltages required in the printing operation under the control of the high voltage controller, and an engine unit forming an image on a sheet of paper from the image data provided from the engine controller using the high voltage output provided from the high voltage output unit.

BRIEF DESCRIPTION OF THE DRAWINGS

These and/or other aspects and advantages of the invention will become apparent and more readily appreciated from the following description of the embodiments taken in conjunction with the accompanying drawings in which.

DETAILED DESCRIPTION OF THE PREFERRED EMBODIMENTS

Figure 1:
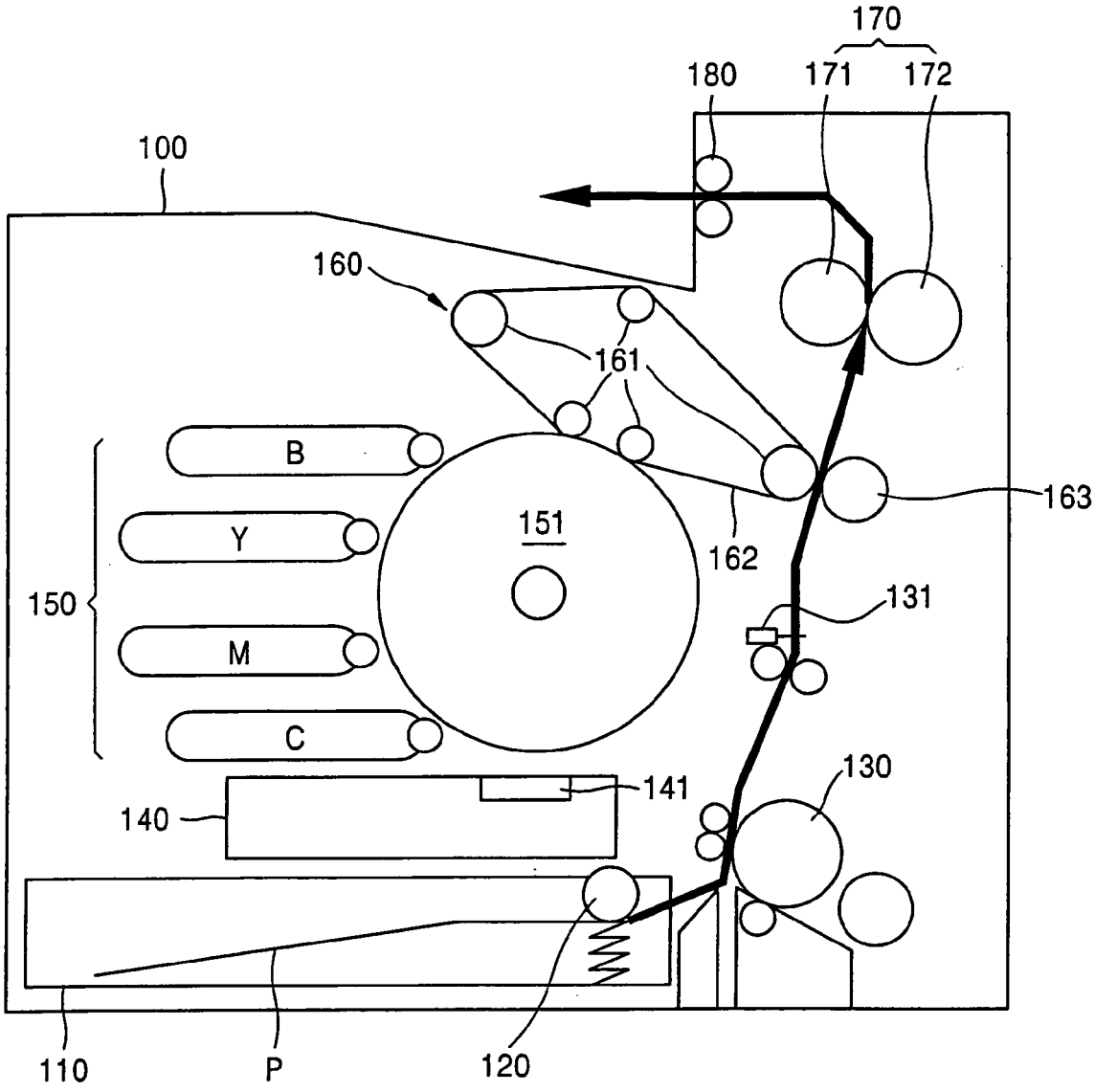
FIG. 1 is a side cross-sectional view illustrating a mechanism of an image forming system using a method of controlling a high voltage output according to an embodiment of the present invention.

Reference will now be made in detail to the embodiments of the present invention, examples of which are illustrated in the accompanying drawings, wherein like reference numerals refer to the like elements throughout. The embodiments are described below to explain the present invention by referring to the figures.

FIG. 1 is a side cross-sectional view of an image forming system using a method of controlling a high voltage output of the present invention. The image forming system includes a loading device 110, a pickup device 120, a paper feeding device 130, an exposure device 140, a developing device 150, a transfer device 160, a fusing device 170, and a paper discharging device 180.

Referring to FIG. 1, the loading device 110, which generally includes a cassette to carry sheets of paper therein, is removably installed in a lower portion of a main body 100. The paper P is picked up by the pickup device 120, which is rotatably installed to rotate in the main body 100, and carried inside the main body 100 in a direction of the arrow.

The pickup device 120 generally includes a pickup roller to draw the paper P out of the loading device 110. The paper feeding device 130 generally includes a paper feeding roller to carry the paper P drawn out of the loading device 110 into the main body 100. A paper feeding sensor 131 detects a front end of the paper P, and senses whether the pickup operation of the paper P from the loading device 110 is successfully performed by the pickup device 120 according to a detection result of the front end of the paper P.

The exposure device 140 scans light corresponding to an image signal onto a photosensitive drum 151, charged to have a uniform potential, to form an electrostatic latent image. The exposure device 140 generally includes a laser scanning unit, which uses a laser diode as a light source, and a light window 141, through which the laser beam radiated from the laser diode is radiated outward, is disposed to face the photosensitive drum 151.

The developing device 150 includes a plurality of ink cartridges, which are installed to contact the photosensitive drum 151 to develop the electrostatic latent image formed on a surface of the photosensitive drum 151 into a predetermined color image by the exposure device 140 in response to the image signal. A developing agent stored in the plurality of ink cartridges overlaps on the electrostatic latent image formed on the photosensitive drum 151, thus forming a predetermined visible image.

The transfer device 160 includes a transfer belt 162, which is supported by a plurality of transfer belt backup rollers 161 and rotates in a closed loop shape and on which the toner image formed on the surface of the photosensitive drum 151 is transferred. The transfer device 160 further includes a transfer roller 163, which is installed to face one of the plurality of transfer belt backup rollers 161 to hold the transfer belt 162 therebetween to press the paper P toward the transfer belt 162. Therefore, the color toner image transferred from the photosensitive drum 151 to the transfer belt 162 is re-transferred onto the paper P. Here, it is desirable that a traveling linear velocity of the transfer belt 162 be equal with a rotation linear velocity of the photosensitive drum 151. Also, a length of the transfer belt 162 should be the same or longer than the paper P, on which the color toner image is finally transferred.

In the transfer device 160, the transfer roller 163 is installed to face the transfer belt 162. The transfer roller 163 is separated from the transfer belt 162 while the color toner image is transferred on the transfer belt 162, and contacts the transfer belt 162 when the color toner image is completely transferred onto the transfer belt 162, to transfer the image onto the paper P.

The fusing device 170 includes a fusing roller 171, and a pressing roller 172, which is installed to face the fusing roller 171 to hold the conveyed paper P therebetween and press the paper toward the fusing roller 171. The fusing roller 171 fuses the visible image on the paper P by heating the paper P, on which the visible image is formed. The paper discharging device 180 generally includes a paper discharging roller to discharge the paper, on which the visible image is formed, outwardly. In order to perform a duplex printing, the paper discharging roller is inversely rotated, and the paper P is reversed and transferred on a reverse path.

Figure 2A:
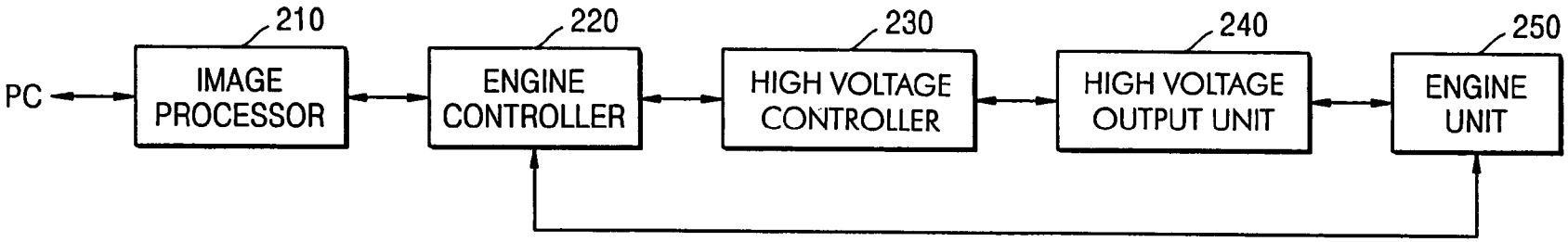
FIGS. 2A and 2B are block diagrams of an apparatus to control a high voltage output according to an embodiment of the present invention.

FIG. 2A is a block diagram of an apparatus to control a high voltage output according to an embodiment of the present invention. The apparatus includes an image processor 210, an engine controller 220, a high voltage controller 230, a high voltage output unit 240, and an engine unit 250.

Referring to FIG. 2A, the image processor 210 converts printing data, which is received from an external device connected to a communication interface, for example, a personal computer (PC), into image data. The image data is suitable for the operation of the engine unit 250, according to printing conditions set in a printer driver, and stores the image data in an internal or external storing medium. The storing medium stores various control programs required to implement functions of the image forming system, various data generated by the image processor 210, and the printing data and printing information received from the personal computer.

The engine controller 220 controls the high voltage controller 230 and the engine unit 250, so that an image corresponding to the image data received from the image processor 210 is printed on the paper. When the engine controller 220 receives a command for printing from the image processor 210, the engine controller 220 controls the engine unit 250 so that various devices 120 through 180 are prepared to perform the printing operation. Preparations for the printing operation may include rotation of a polygonal rotating mirror or a scan disk, that is, a deflection unit of the exposure device 140 at a predetermined speed required during the printing operation, heating of the fusing device 170 to a predetermined temperature, or inspections of the devices 120, 130, 140, 160, 170 and 180. Therefore, when the engine controller 220 decides that the printing operation can be performed via the preparations of the printing operation after receiving the command for printing from the image processor 210, the engine controller 220 applies a printing start signal to the image processor 210 and provides the exposure device 140 with the image data stored in the storing medium through the engine controller 220.

The high voltage controller 230 analyzes the command received from the engine controller 220 to decide a predetermined timing and output level for the high voltage output, and provides the high voltage output unit 240 with the decided time and output level.

The high voltage output unit 240 generates charging high voltage, developing high voltage, first and second transferring high voltages, cleaning high voltage, or paper adsorbing high voltage, and provides each device of the engine unit 250 with the generated high voltage. Here, PWM ports and controlling ports disposed between the devices of the high voltage output unit 240 and the engine unit 250 operate according to the high voltage output timing and control duties of PWM signals. The ports decide whether the high voltage is output or not while changing a high voltage output level, or to decide whether the high voltage is output or not via an on/off controlling operation in a case where the high voltage output level is fixed.

The engine unit 250 includes various devices required to perform the printing operation, i.e., the pickup device 120, the paper feeding device 130, the exposure device 140, the developing device 150, the transfer device 160, the fusing device 170, and the paper discharging device 180 shown in FIG. 1. The engine unit 250 may have various structures according to the printing method.

Figure 2B:
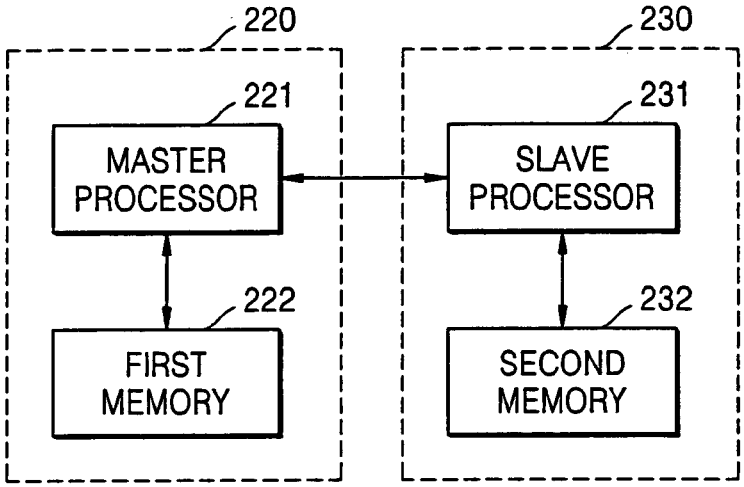

FIG. 2B is a block diagram of detailed structures of the engine controller 220 and the high voltage controller 230 of FIG. 2A. The engine controller 220 includes a master processor 221 and a first memory 222, and the high voltage controller 230 includes a slave processor 231 and a second memory 232.

Referring to FIG. 2B, the master processor 221 in the engine controller 220 controls the entire operation of the engine unit 250 according to a control program stored in the first memory 222. The master processor 221 also provides the slave processor 231 in the high voltage controller 230 with a synchronization signal to output high voltage, the high voltage output timing, and the high voltage output level stored in the first memory 222. The synchronization signal for the high voltage output may be generated when the paper feeding sensor 131 senses the paper P, or may be generated by a page synchronization signal, which is generated when the first transfer operation is performed on the paper after the sensor 131 senses the paper. The first memory 222 stores image data, various control programs, developing conditions, timing for high voltage output and high voltage output level provided from the image processor 210. The developing conditions stored in the first memory 222 are updated at every printing operation.

In the high voltage controller 230, the slave processor 231 analyzes the command, which includes the synchronization signal for the high voltage output, provided from the master processor 221, to generate a control signal for the high voltage output including a high voltage output timing and output level with respect to each color, and provides the control signal for the high voltage output to the high voltage output unit 240. The second memory 232 may include an EEPROM, and stores the high voltage output timing and the high voltage output level decided by the slave processor 231.

Communication between the master processor 221 and the slave processor 231 may be performed by a wired serial communication such as a serial input output or a universal asynchronous receiver/transmitter, or by a wireless radio frequency communication. In the wired serial communication, the number of wires can vary if a communication between the master processor 221 and the slave processor 231 meets a predetermined interface protocol. Here, a control signal line between the master processor 221 and the slave processor 231 includes a transmission signal, a receive signal, and a synchronization signal.

In the above structure, since the slave processor 231 is an independent module, which is different from the master processor 221, it is easy to re-design the slave processor 231 even when a platform of the master processor 221 is changed. In addition, since the number of pins in a harness, which is used in the communication between the master processor 221 and the slave processor 231, is reduced, noise is reduced. Also, since the slave processor 231 actually performs the control of the high voltage, usable time of the master processor 221 increases and the master processor 221 can be realized by a processor having a low price.

Figure 3:
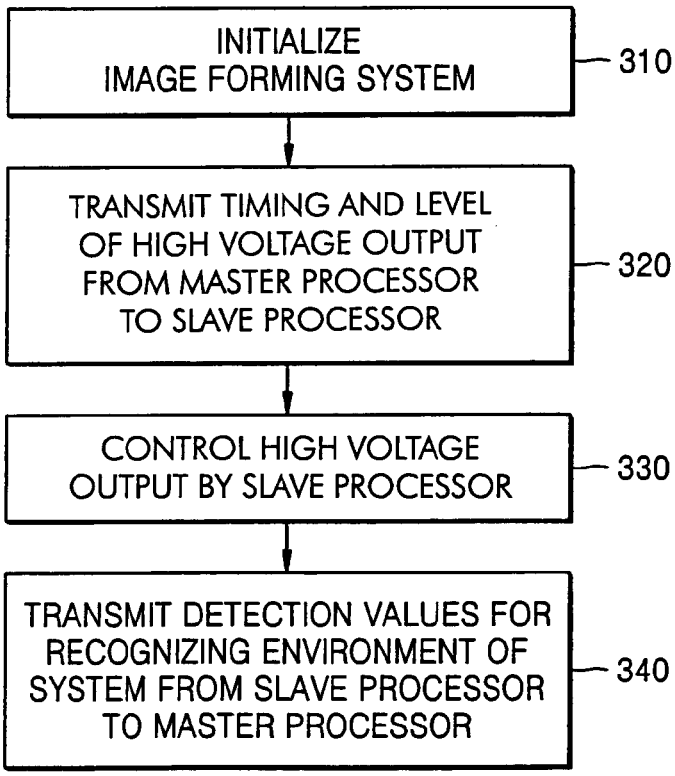
FIG. 3 is a flow chart of a method of controlling a high voltage output according to an embodiment of the present invention.

FIG. 3 is a flow chart of a method of controlling a high voltage output according to the embodiment of the present invention.

Referring to FIG. 3, the system is initialized when the power of the image forming system is turned on. When the initialization is completed in operation 310, the high voltage output timing and the high voltage output level are transmitted from the master processor 221 of the engine controller 220 to the slave processor 231 of the high voltage controller 230 in operation 320. Here, if the high voltage output timing and level with respect to the previous printing operation are stored in the slave processor 231, operation 320 may be omitted.

When the transmission of the high voltage output timing and level is completed from the master processor 221 to the slave processor 231 in operation 320, if the high voltage output synchronization signal is supplied from the master processor 221, the slave processor 231 controls the high voltage output unit 240 according to the high voltage output timing in operation 330.

The slave processor 231 measures a detection value for environment recognition in the image forming system and transmits the value to the master processor 221, so that the high voltage timing and level can be controlled by the master processor 221 depending on an elapsed lifespan of the engine unit 250.

Figure 4:
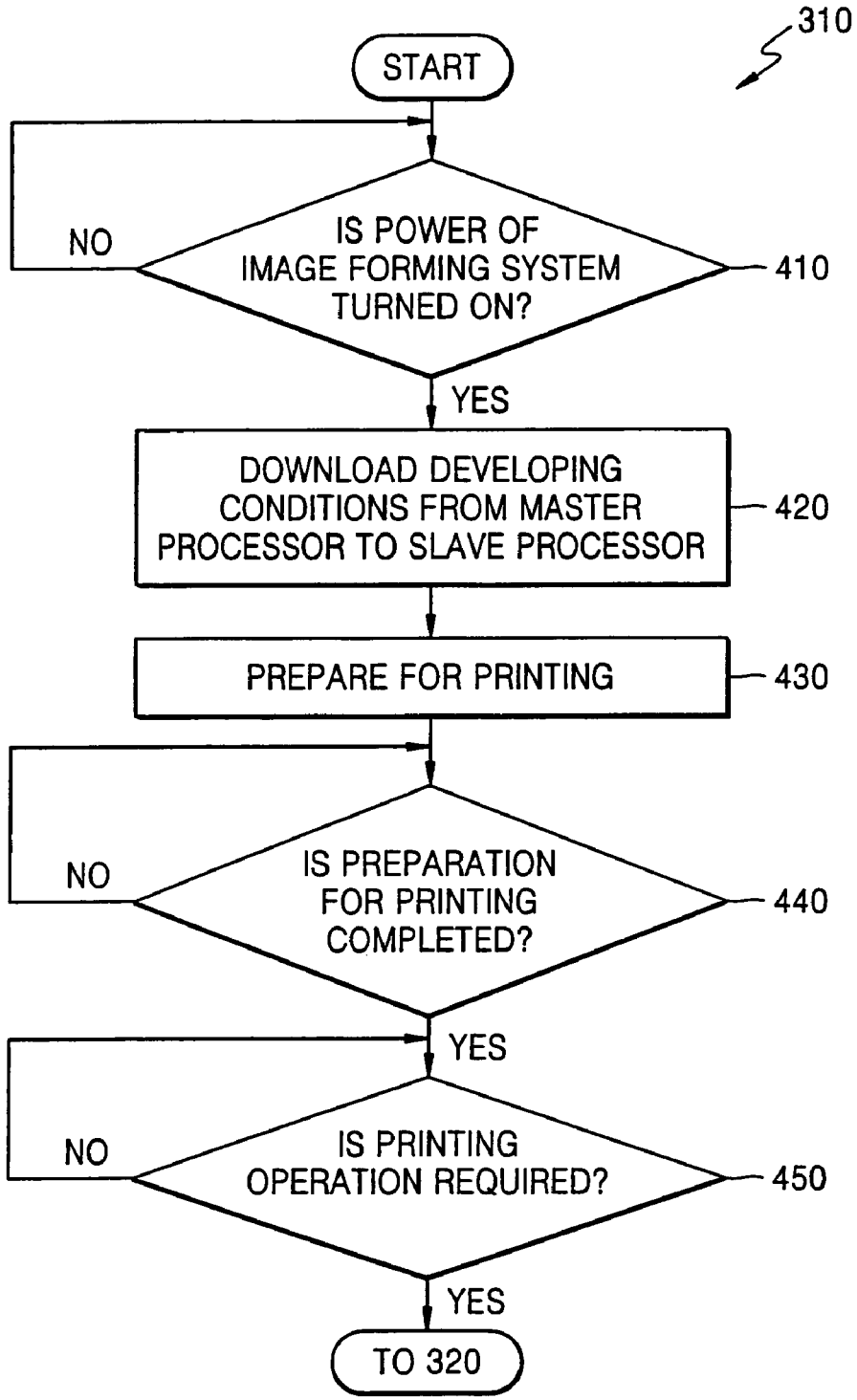
FIG. 4 is a flow chart of operations of operation 310 shown in FIG. 3.

FIG. 4 is a flow chart of sub-operations of operation 310 shown in FIG. 3.

Referring to FIG. 4, in operation 410, it is determined whether the power of the image forming system is turned on/off. If the power of the image forming system is turned on, developing conditions of the previous printing operation are downloaded from the master processor 221 to the slave processor 231 in operation 420.

The master processor 221 controls the devices 120, 130, 140, 150, 160 and 180 of the engine unit 250 to be prepared to perform the printing operation in operation 430, and decides whether the preparations for the printing operation are completed or not. If the preparations for the printing operation are completed in operation 440, it is decided whether a printing instruction command is input in operation 450. If the printing instruction command is input, operation 320 is performed.

Figure 5:
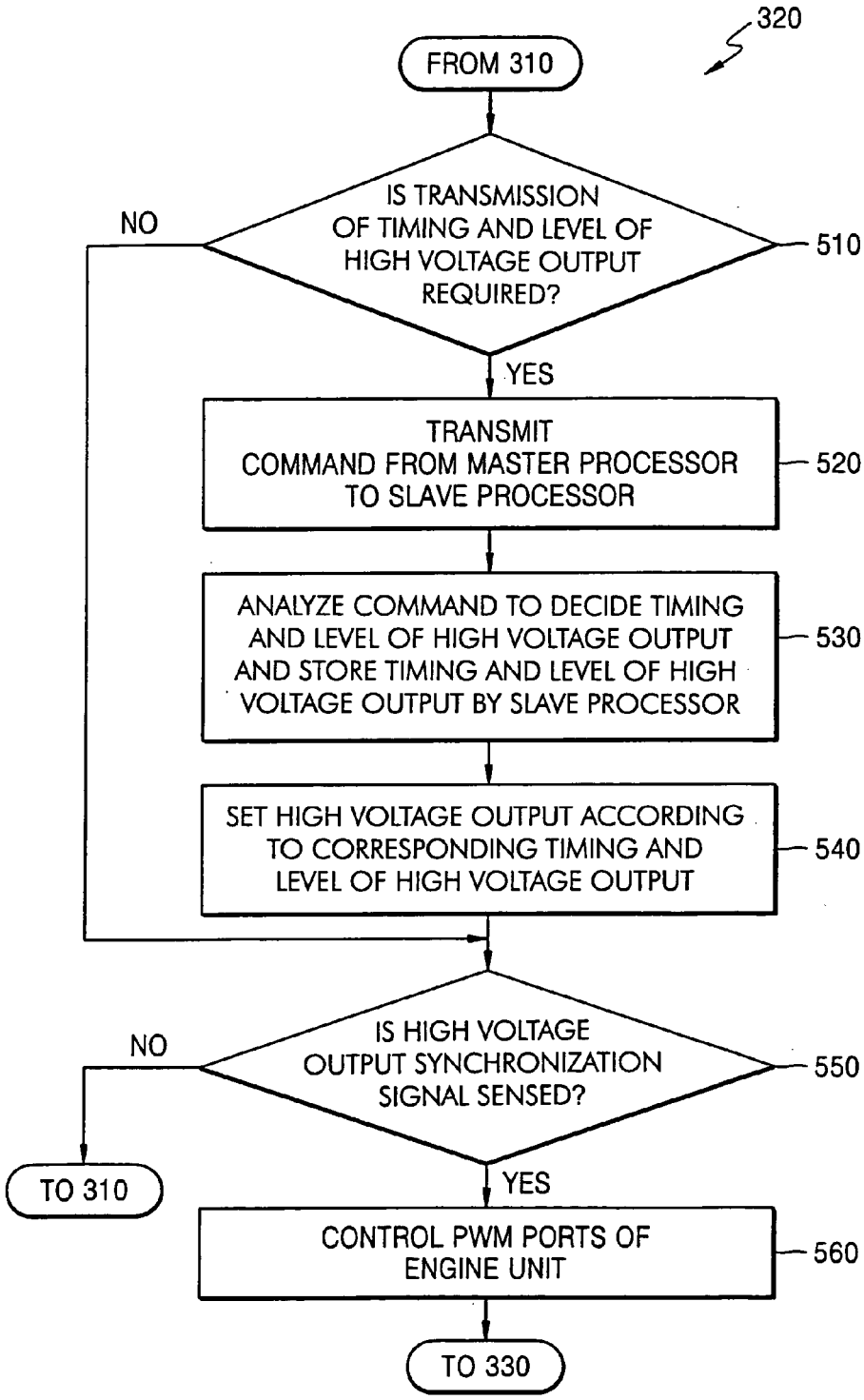
FIG. 5 is a flow chart of operations of operation 320 shown in FIG. 3.

FIG. 5 is a flow chart of sub-operations of operation 320 shown in FIG. 3. Referring to FIG. 5, it is decided whether the slave processor 231 requires the master processor 221 to transmit the high voltage output timing and level.

If the slave processor 231 requires the master processor to transmit the high voltage output timing and level in operation 510, the master processor 221 generates commands corresponding to the high voltage output and level, which are stored in the first memory 222, and transmits the commands to the slave processor 231 in operation 520. On the other hand, if the slave processor 231 does not require the master processor to transmit the high voltage output timing and level, it means that the high voltage output timing and level, which are used in the previous printing operation, are stored in the second memory 232.

The slave processor 231 analyzes the commands transmitted from the master processor 221 to decide the high voltage output timing and level, and stores the timing and level in the second memory 232. Outputs of the high voltage are set in operation 540 according to the high voltage output timing and level decided in operation 530.

It is monitored that the high voltage output synchronization signal is transmitted from the master processor 221 in operation 550. In a case where the high voltage output synchronization signal is not transmitted within a predetermined time in operation 550, it can be decided that a jam is generated, and predetermined operations for processing the jam are performed and operation 440 in the initialization process is performed. If the high voltage output synchronization signal is transmitted from the master processor 221 within a predetermined time in operation 550, the PWM ports corresponding to the devices of the engine unit 250 are controlled according to the high voltage outputs in operation 560.

Figure 6:
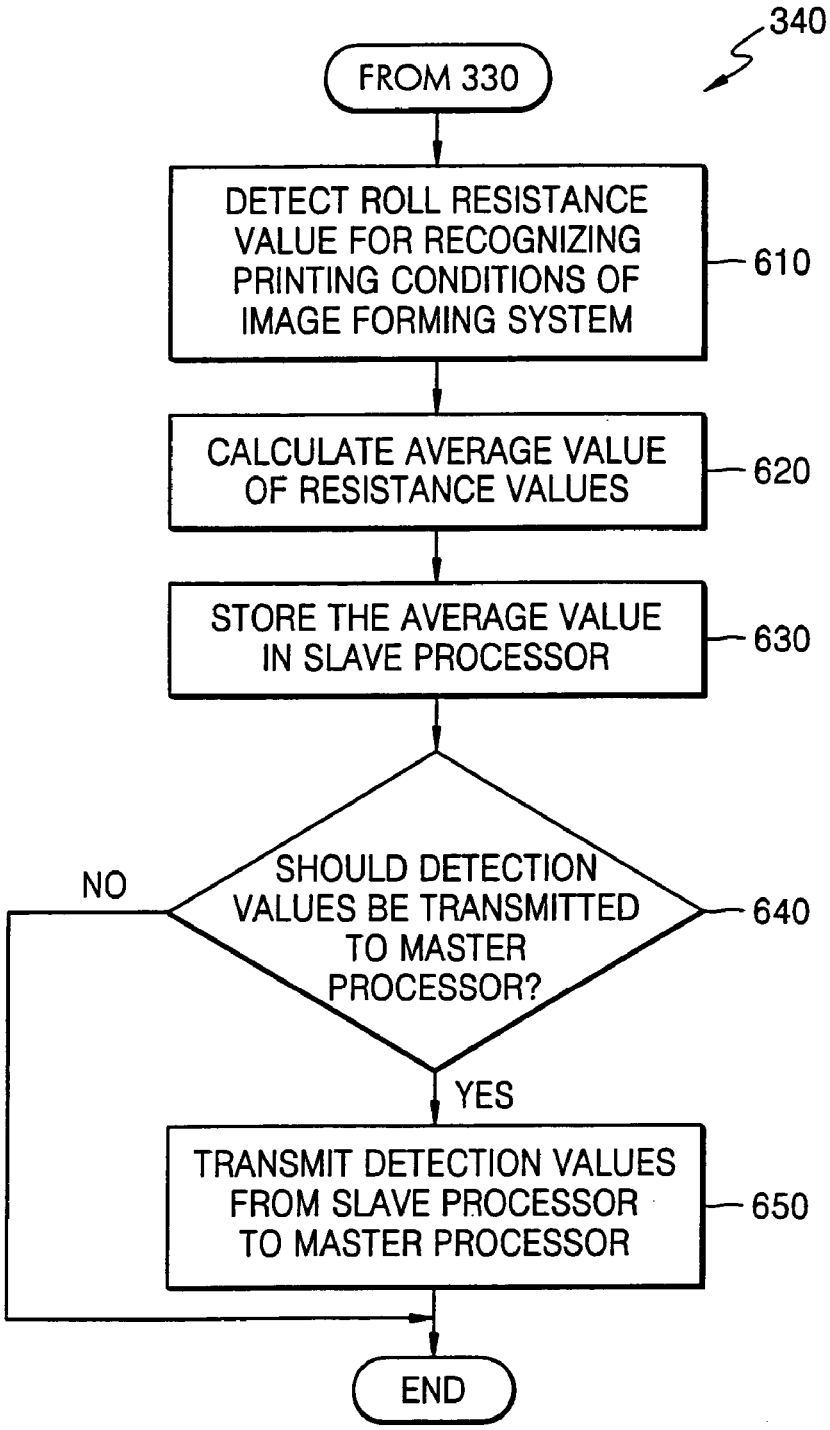
FIG. 6 is a flow chart of operations of operation 340 shown in FIG. 3.

FIG. 6 is a flow chart of sub-operations of operation 340 shown in FIG. 3. Referring to FIG. 6, detection values for environment recognition of the image forming system are measured at every predetermined time by the engine unit 250, since the image forming system is operated in operation 610. The detection values may be roll resistance values of the charging roller, the first transfer roller, and the second transfer roller. The roll resistance values are changed due to elements such as the elapsed lifespan of the system, and rising of the inner temperature of the system, and accordingly, the charging high voltage, or the first and second transfer high voltages should be controlled. The measured detection values are converted into digital data via an analog/digital conversion operation.

In operation 620, an average value of the detection values, which are measured N times in operation 610, is calculated by the slave processor 231, and the average value of the detection values is stored in the second memory 232 in operation 630. The slave processor 231 decides whether the detection values must be transmitted to the master processor 221 or not in operation 640. If a difference between the average value, which is previously stored in the second memory 232, and the average value of the detection values, which is calculated in operation 620, is in a predetermined tolerance range, the detection values are not transmitted to the master processor 221. However, the difference between the average values is out of the predetermined tolerance range, the detection values are transmitted to the master processor 221 in operation 650.

In a case where the detection values are transmitted to the master processor 221, the slave processor 231 transmits the detection values to the master processor 221, and the master processor 221 controls the high voltage output timing and level according to the received detection values and stores the controlled timing and level in the first memory 222.

The method of controlling high voltage output according to the present invention can be applied to numerous image forming systems, regardless of the image forming methods such as the single-pass method and the multi-pass method.

The method of the present invention can be realized as a computer-readable code in a computer-readable recoding medium. The computer-readable recording medium includes all kinds of recording media, in which the computer-readable data is stored. The recording medium may be a ROM, a RAM, a CD-ROM, a magnetic tape, a floppy disk, or an optical data recording medium, or also can be realized as a carrier wave. Also, the computer-readable paper is distributed to the computer systems connected by a network, and can store and perform the computer-readable code in a distributed way. In addition, functional program, code, and code segment for realizing the present invention can be easily detected by those skilled in the art.

According to the present invention, the control signal line between the engine control module and the high voltage output module is simplified, thus simplifying the equipment such as the harness. As such, since a structure of the harness can be simplified, assembly and fabrication of the system can be made conveniently, thus reducing the fabrication cost. Also, since the high-voltage output module is operated independently from the engine control module, the system can be realized using a low price master processor having low operational speed, and it is easy to re-design the high voltage output module when the platform of the master processor is changed. Also, PWM clock signals included in the control signal line between the engine control module and the high voltage output module can be reduced, thus an additional driver is not required and an electromagnetic interference output level can be reduced.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A method of controlling a high voltage output in an image forming system, the method comprising:

setting a master processor to control an engine, and setting a slave processor to control the high voltage output;

transmitting a command, which includes a timing and a level of the high voltage output, from the master processor to the slave processor;

receiving and analyzing the transmitted command by the slave processor;

determining the timing and the level of the high voltage output; and controlling the high voltage output according to a predetermined high voltage output synchronization signal received by the slave processor.

2. The method of claim 1, further comprising:

measuring detection values for environment recognition in the image forming system during a predetermined period, and transmitting the measured values to the master processor by the slave processor; and controlling the timing and the level of the high voltage output according to the transmitted command by the master processor.

3. The method of claim 2, wherein the measuring of the detection values comprises transmitting detection values detected in a present period to the master processor, if a difference between the detection values detected in the present period and detection values detected in a previous period exceeds a predetermined tolerance range.

4. The method of claim 1, wherein the transmitting of the command comprises:

determining whether demands for the timing and the level of the high voltage output are received from the slave processor;

generating the command, which includes the timing and the level of the high voltage output, if the demands for the timing and the level of the high voltage output are received; and transmitting the command from the master processor to the slave processor.

5. The method of claim 1, wherein the determining of the timing comprises:

analyzing the transmitted command to determine the timing and the level of the high voltage output and storing the timing and the level in a predetermined storing medium;

setting the high voltage output according to the timing and the level of the high voltage output;

determining whether the high voltage output synchronization signal is transmitted from the master processor; and voltage output synchronization signal is transmitted from the master processor, controlling pulse width modulation ports and control ports connected to devices in an engine unit according to the high voltage output if the high voltage output synchronization signal is transmitted from the master processor.

6. The method of claim 1, wherein the transmitting and receiving by the master processor and the slave processor comprise using a wired serial communication.

7. The method of claim 1, wherein the transmitting and receiving by the master processor and the slave processor comprise using wireless radio frequency communication.

8. The method of claim 1, further comprising generating the high voltage output synchronization signal when a paper feeding sensor senses a paper.

9. The method of claim 1, wherein the high voltage output synchronization signal is a page synchronization signal.

10. A computer-readable recording medium having stored thereon a program to perform the method of controlling a high voltage output in an image forming system as recited in claim 1.

11. An apparatus to control a high voltage output in an image forming system, the apparatus comprising:

a first memory storing a control program, and a timing and a level of the high voltage output, which are used in a previous printing operation;

a master processor performing engine controlling operations using the control program stored in the first memory, and transmitting a command including the timing and the level of the high voltage output stored in the first memory;

a slave processor determining the timing and the level of the high voltage output by analyzing the generated command, which is received from the master processor, and controlling the high voltage output according to a high voltage output synchronization signal; and a second memory storing the timing and the level of the high voltage output determined by the slave processor.

12. The apparatus of claim 11, wherein the slave processor measures detection values for environment recognition in the image forming system at predetermined periods and transmits the measured values to the master processor, and the master processor controls the timing and the level of the high voltage output according to the values received from the slave processor.

13. The apparatus of claim 11, wherein the master processor and the slave processor transmit and receive using a wired serial communication.

14. The apparatus of claim 11, wherein the master processor and the slave processor transmit and receive using a wireless radio frequency communication.

15. The apparatus of claim 11, wherein the high voltage output synchronization signal is a paper sensing signal of a paper feeding sensor or a page synchronization signal.

16. An image forming system comprising:

an image processor converting printing data, which is received from an apparatus requiring a printing operation, into image data driving an engine;

an engine controller receiving the image data from the image processor, performing an engine controlling operation using a predetermined control program, and generating a command including a timing and a level of a high voltage output;

a high voltage controller determining the timing and the level of the high voltage output by analyzing the generated command, which is received from the engine controller, and controlling the high voltage output according to a predetermined high voltage output synchronization signal;

a high voltage output unit generating a plurality of the high voltage outputs required in the printing operation under the control of the high voltage controller; and an engine unit forming an image on a sheet of paper from the image data using the high voltage output, wherein the engine controller and the high voltage controller are constructed in a master/slave structure.

17. A method of controlling a high voltage output in an image forming system, the method comprising:

transmitting a signal from a master processor to a slave processor;

determining whether the transmitted signal is a high voltage output synchronization signal; and controlling the high voltage output according to the high voltage output synchronization signal if the transmitted signal is the high voltage output synchronization signal.

18. The method of claim 17, further comprising:

transmitting a command from the master processor to the slave processor, the command comprising a timing and a level of the high voltage output; and determining the timing and the level of the high voltage output by the slave processor according to the transmitted command.

19. The method of claim 18, wherein the determining of the timing and the level comprises:

measuring detection values for environment recognition;

calculating an average value of the measured detection values; and storing the calculated average value in the slave processor.

20. The method of claim 19, wherein the measuring of the detection values comprises measuring a roll resistance of the image forming system.

21. The method of claim 20, further comprising:

determining whether to transmit the measured detection values to the master processor.

22. The method of claim 21, wherein the determining whether to transmit the measured detection values comprises:

determining whether a difference between the calculated average value and a stored average value is within a stored tolerance range; and transmitting the measured detection values if the determined difference is not within the stored tolerance range.

23. An apparatus to control a high voltage output in an image forming system, the apparatus comprising:

a master processor to transmit a signal; and a slave processor to receive the transmitted signal, and to control a timing and a level of the high voltage output if the received signal comprises a high voltage output synchronization signal.

24. A system to form an image comprising:

an engine to form an image on a sheet of paper;

an engine controller to control the engine according to a high voltage output;

a controller to determine a timing and a level of the high voltage output; and an output unit to output a plurality of high voltages required to form the image under the control of the controller, according to a predetermined high voltage output synchronization signal, wherein the output unit is operated independently from the controller.

25. The system of claim 24, wherein the engine controller and the controller comprise a master/slave relationship.

* * * * *